US009777559B2

(12) United States Patent
Zhan et al.

(10) Patent No.: US 9,777,559 B2
(45) Date of Patent: Oct. 3, 2017

(54) RELIABILITY ASSESSMENT AND RISK MANAGEMENT FOR MANAGED PRESSURE DRILLING

(71) Applicants: China Petroleum & Chemical Corporation, Beijing (CN); Sinopec Tech Houston, LLC., Houston, TX (US)

(72) Inventors: Sheng Zhan, Houston, TX (US); Jinhai Zhao, Houston, TX (US); Herong Zheng, Houston, TX (US); Weiping Xu, Houston, TX (US)

(73) Assignees: CHINA PETROLEUM & CHEMICAL CORPORATION, Beijing (CN); SINOPEC TECH HOUSTON, LLC, Houston, TX (US)

( * ) Notice: Subject to any disclaimer, the term of this patent is extended or adjusted under 35 U.S.C. 154(b) by 828 days.

(21) Appl. No.: 14/265,265

(22) Filed: Apr. 29, 2014

(65) Prior Publication Data

US 2015/0308237 A1 Oct. 29, 2015

(51) Int. Cl.
*G06G 7/48* (2006.01)
*E21B 43/12* (2006.01)

(52) U.S. Cl.
CPC ..... *E21B 43/12* (2013.01)

(58) Field of Classification Search
CPC ..... E21B 43/12; E21B 44/00; E21B 47/12; G06F 2217/76
USPC ..... 703/10
See application file for complete search history.

(56) References Cited

PUBLICATIONS

Molaschi, Claudio, Silvia Masi, Fabrizio Zausa, Nicola Rossi, and Jean Michelez. "Near balance drilling benefits addressed through a blowout probability model." In SPE/IADC Managed Pressure Drilling and Underbalanced Operations Conference and Exhibition. Society of Petroleum Engineers, 2012.*

McDonald, Patrick. "A Probabilistic Approach to Risk Assessment of Managed Pressure Drilling in Offshore Applications." Contract 106 (2008): 31.*

Abimbola, Majeed, Faisal Khan, and Nima Khakzad. "Dynamic safety risk analysis of offshore drilling." Journal of Loss Prevention in the Process Industries 30 (2014): 74-85.*

Engevik, Mari Oma. "Risk Assessment of Underbalanced and Managed Pressure Drilling Operations." PhD diss., MSc. Thesis. Norway: NTNU, 2007.*

Fossli, B., S. Sangesland, O. S. Rasmussen, and P. Skalle. "Managed-pressure drilling; techniques and options for improving efficiency, operability, and well safety in subsea TTRD." In Offshore Technology Conference. Offshore Technology Conference, 2006.*

Baligira, Robert. "The effect of Macondo blowout on risk analysis and risk management." Master's thesis, University of Stavanger, Norway, 2013.*

* cited by examiner

*Primary Examiner* — Aniss Chad
(74) *Attorney, Agent, or Firm* — Novick, Kim & Lee, PLLC; Allen Xue

(57) ABSTRACT

A managed pressure drilling (MPD) system employs reliability models such as Failure Modes and Effects Analysis (FMEA), Fault Tree Analysis (FTA), Ishikawa diagram, Pareto chart, Reliability Block Diagram (RBD) in assessing and optimizing the system reliability. The MPD drilling system is suitable for offshore drilling operations.

13 Claims, 4 Drawing Sheets

RELIABILITY ASSESSMENT AND RISK MANAGEMENT FOR MANAGED PRESSURE DRILLING

TECHNICAL FIELD

The present disclosure relates to systems and methods for managed pressure drilling system, particularly for assessing and optimizing system to improve system reliability.

BACKGROUND

In modern drilling practices, the drilling fluid (or mud) acts as the medium for primary well control. Two major well control issues are kicks and drilling fluid (i.e., drilling mud or mud) losses. A kick refers to an event in which an uncontrolled influx of fluids (e.g., oil, gas) from the formation into the wellbore. In extreme cases, the oil and gas escape from the wellbore into open air (i.e, a gusher), causing catastrophic events like fires and explosions. The drilling fluid fills the wellbore, creating a pressure gradient that is larger than the formation pressure gradient (a.k.a., pore pressure gradient) so that the formation fluid is locked in the formation during the drilling process.

On the other hand, if the pressure gradient of the drilling fluid is too high and exceeds the fracture pressure gradient of the formation (i.e., the pressure at which the formation starts to fracture), the drilling fluid may penetrate the formation, causing drilling fluid loss and even collapsing the borehole. In such instances, the formation needs to be protected by casings, which is lowered down through the borehole. A few such casings would quickly reduce the size of the wellbore at the well bottom, rendering it too small for industrial production. Accordingly, the pressure gradient of the drilling fluid shall stay between the formation pressure gradient and the fracture pressure gradient (i.e., the drilling window).

As oil and gas explorations venture into more complex geological conditions, such as in deep sea oil explorations, the drilling window becomes narrower and more irregular. Kicks not only come from drilling through layers of formations having different formation pressure gradients, but also are frequently induced by routine operations such as tripping. Therefore, faster and more accurate control of the drilling fluid pressure gradient becomes more important.

Managed pressure drilling (MPD) is an enhanced drilling method that addresses some of the challenges described above. Instead of using a drilling fluid system that is open to the air, the MPD closes the drilling fluid loop to the air using equipment including a rotating control device (RCD), drilling string non-return valves (NRV), and a dedicated choke manifold. Simply put, the additional equipment seals off the drilling fluid from the air and exerts an actively controlled back pressure to the drilling fluid. The back pressure allows the operator to use a lighter drilling fluid so that drilling may occur at a pressure gradient closer to the formation pressure gradient, effectively extending the operable drilling window. In addition, the back pressure can be quickly adjusted upon the detection of any sign of kicks or fluid losses, more effectively controlling the well conditions, such as the Bottom Hole Pressure (BHP). BHP is the pressure at the bottom of a well. MPD enables a stable BHP and avoids oscillations of the BHP during the drilling.

Furthermore, better pressure control also reduces incidences of formation fracture and consequently reduces or avoids complex casing operations. As a result, the well bottom maintains a size large enough for production purposes. Accordingly, an increasing number of drilling operations are adopting the MPD method, especially in offshore deepwater drilling operations.

Despites the benefits of using MPD drilling systems, major concerns such as kicks and mud loss still exist in tight drilling windows. Sensitive kick detection methods, comprehensive well control procedures and adequate kick processing equipment (separators, flare booms, etc), are critical elements of prudent MPD well design. Therefore, there is a need for methods and equipment for optimizing drilling and well construction for the MPD drilling system.

SUMMARY

The present disclosure provides methods for optimizing drilling and well construction for the MPD drilling system. In one embodiment, the method includes designing a MPD drilling system comprising a rotating control device (RCD), a drilling string non-return valve (NRV), a choke manifold, as well as various downhole drilling tools wherein the MPD drilling system is configured to carry out a MPD operation. The method also involves identifying failure modes of the MPD drilling system and use one or more reliability models to assess the probability of occurrence of a failure mode. Based on the assessment, new or improved well control schemes can be devised and implemented.

Any suitable reliability models can be used for the reliability assessment, including Failure Modes and Effects Analysis (FMEA), Fault Tree Analysis (FTA), Ishikawa diagram, Pareto Chart, and Reliability Block Diagram (RBD). The failure modes in the MPD drilling system includes inability to making drilling mud, lost circulation, gain in mud pit level, incorrect mud weight measurements level, change of mud properties, absence of kill weight mud, inability to stab-in Inside Blowout Preventer (IBOP) or Full-Opening Safety Valve (FOSV), line rupture, loss of pressure control, unexpected gas to surface, gas in riser, obstruction in pump line, failure of pump, wellbore instability, continuous wellbore influx, high Bottom Hole Pressure (BHP), formation fracture, kick, BHP surge, unsuccessful well control, lost circulation, inability to remedy mud loss, high Equivalent Circulating Density (ECD), etc.

The present disclosure also provides a MPD drilling system. The system comprises a rotating control device (RCD), a drilling string non-return valve (NRV), and a choke manifold, BOP, a mud system, as well as various downhole drilling tools and may comprise risers for offshore drilling. The reliability of the system is assessed using one or more reliability models chosen from a Failure Modes and Effects Analysis (FMEA), a Fault Tree Analysis (FTA), Ishikawa diagram, Pareto chart, Reliability Block Diagram (RBD), and combinations thereof.

BRIEF DESCRIPTION OF THE DRAWINGS

The teachings of the present invention can be readily understood by considering the following detailed description in conjunction with the accompanying drawings.

DETAILED DESCRIPTION

Figure 1:
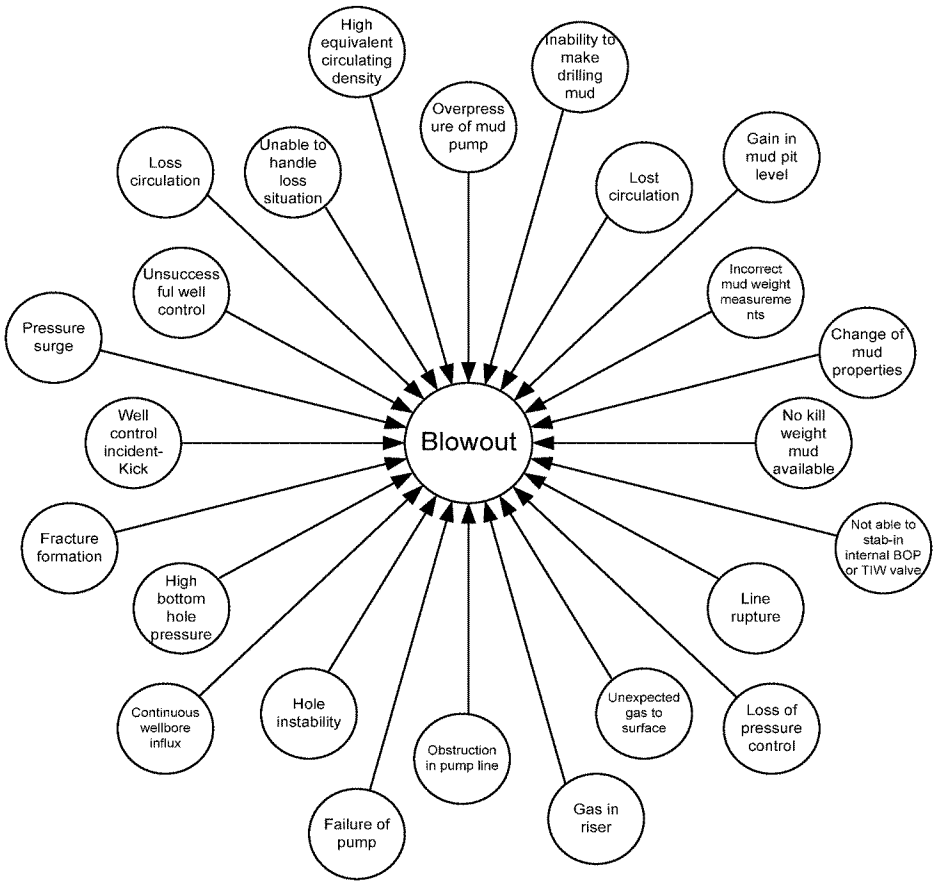
FIG. 1 is a schematic illustration of failure modes and relations among these failure modes.

Reference will now be made in detail to embodiments of the present disclosure, examples of which are illustrated in the accompanying drawings. It is noted that wherever practicable, similar or like reference numbers may be used in the drawings and may indicate similar or like elements.

The drawings depict embodiments of the present disclosure for purposes of illustration only. One skilled in the art would readily recognize from the following description that alternative embodiments exist without departing from the general principles of the present disclosure.

The terminology used herein, unless otherwise noted, is consistent with drilling glossary used in oil field services industry, for example, as described in "A Dictionary for the Oil and Gas Industry, 2nd Ed." published in 2011, by Petroleum Extension Service.

According to one aspect of the current disclosure, the failure modes of a MPD drilling operation include inability to make drilling mud, kick, lost circulation, gain in mud pit level, incorrect mud weight measurements level, change of mud properties, absence of kill weight mud, inability to stab-in Inside Blowout Preventer (IBOP) or Full-Opening Safety Valve (FOSV), line rupture, loss of pressure control, unexpected gas to surface, gas in riser, obstruction in pump line, failure of pump, wellbore instability, continuous wellbore influx, high Bottom Hole Pressure (BHP), formation fracture, BHP surge, unsuccessful well control, lost circulation, inability to remedy mud loss, high Equivalent Circulating Density (ECD), bottom hole size too small for production, etc. Each of the failure mode can be assessed using one or more reliability models.

According to one aspect of the current disclosure, the Failure Modes and Effects Analysis (FMEA) is used as a reliability model to assess the MPD drilling system's reliability. FMEA is a systematic approach for examining and preventing potential failures. It provides a system of ranking, or prioritization, so the most likely failure modes can be addressed. FMEA is applied during the initial stages of the pre-planning process of MPD operations, including offshore drillings. Various potential failure modes are proposed, their causes, their severity, and their likelihood of occurring are estimated and recorded.

In one aspect of the FMEA method, the severity of one of more failure modes is ranked and assigned a numerical value. An example for ranking severity of a failure mode is shown in Table 1.

TABLE 1

| | Severity of Effect | Ranking |
|---|---|---|
| Minor | Unreasonable to expect that the minor nature of this failure would cause any real effect on the assembly or system performance. Customer will probably not notice the failure. | 1 |
| Low | Low severity ranking due to nature of failure causing only a slight customer annoyance. Customer will probably only notice a slight deterioration of the system or assembly performance. | 2<br>3 |
| Moderate | Moderate ranking because failure causes some customer dissatisfaction. Customer will notice the defect and requires minor rework. | 4<br>5<br>6 |
| High | High degree of customer dissatisfaction due to major required rework. | 7<br>8 |
| Very High | Very high severity ranking when a potential failure mode affects safety or scraps the assembly. | 9<br>10 |

The likelihood of the occurrence of the failure (OCC) is also ranked, for example, as shown in Table 2.

TABLE 2

| | Probability of Failure | Ranking |
|---|---|---|
| Remote | Failure unlikely. No failures ever associated with almost identical processes. Cpk > 3.0. | 1 |
| Very low | Process is in statistical control. Capability shows a Cpk ≥1.33. Only isolated failures associated with almost identical processes. | 2 |
| Low | Process is in statistical control: Capability shows a Cpk > 1.00. Isolated failures associated with similar processes. | 3 |
| Moderate | Generally associated with processes similar to previous processes which have experienced occasional failures, but not in major proportions. Process is in statistical control with a Cpk ≤ 1.00. | 4<br>5<br>6 |
| High | Generally associated with processes similar to previous. processes that have often failed. Process is not in statistical control. | 7<br>8 |
| Very High | Failure is almost inevitable. | 9<br>10 |

The likelihood of the detection of a failure (DET) can also be ranked, for example, as shown in Table 3.

TABLE 3

| | Likelihood of Detection | Ranking |
|---|---|---|
| Very high | Process control will almost certainly detect the existence of a defect. (Process automatically detects failure.) | 1<br>2 |
| High | Process control has a good chance of detecting the existence of a defect. | 3<br>4 |
| Moderate | Process control may detect the existence of a defect. | 5<br>6 |
| Low | Process control has a poor chance of detecting the existence of a defect. | 7<br>8 |
| Very low | Process control probability will not detect the existence of defect. | 9 |
| Absolute certainly of non-detection | Process control will not or cannot detect the existence of a defect. | 10 |

For each failure mode, a risk priority number (RPN) can be calculated according to the following equation:

$$RPN=SEV*OCC*DET$$

FIG. 1 shows the failure modes that may lead to a blowout in an offshore MPD drilling operation. Small circles represent various failure modes. The arrows from the small circle to the center circle (representing well blowout) indicate the casual relations between the failure modes and the well blowout. Each failure mode has its corresponding RPN. The sum of the RPNs for the failure modes is the RPN for the overall system. Modifications to the system and process aimed to reduce RPN of individual failure mode may result in reduction of the RPN of the overall system.

According to another aspect of the current disclosure, Fault Tree Analysis (FTA) is employed as a reliability model to assess the MPD drilling system's reliability. FTA is a deductive method that determines potential causes for failures and to estimate failure probabilities of MPD operations, including offshore drilling operations.

The FTA analysis defines a failure event, e.g., well blowout. Failure modes that may cause the failure events are identified, numbered, and sequenced in the order of occurrence. The fault tree is the constructed using various event symbols and gate symbols known in the field. Boolean algebra can be applied to the fault tree to develop algebraic relationships between events and to simplify expressions using Boolean algebra. The probabilities of each intermediate event (e.g., BOP equipment failure) and the top event (e.g., blowout) can be determined using probabilistic methods.

One aspect of the FTA analysis is that the evaluation can either proceed from the top event to the basic events or vice versa. Furthermore, the evaluation can employ the minimum cut set approach. A cut set is a basic event whose occurrence causes the top event to occur. If any basic event is removed from a minimum cut set, the remaining events are no longer a cut set. The cut sets can be identified using computer algorithms. Once all cut sets are identified, the top event is a combination of all minimum cut sets by OR gate.

Figure 2:
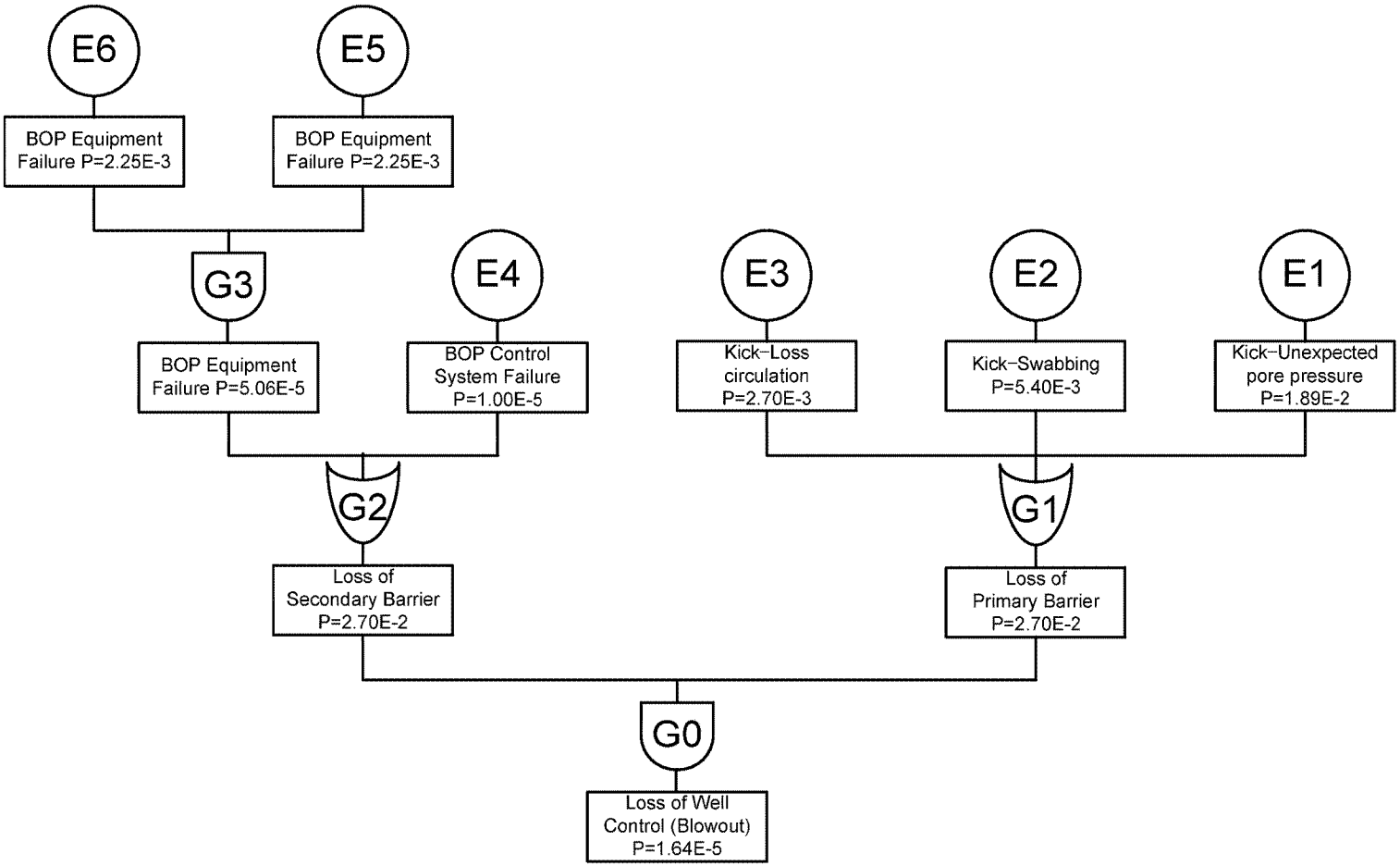
FIG. 2 is an example of fault tree analysis of a MPD drilling system.

FIG. 2 shows an example of applying FTA in analyzing a MPD drilling system in operation. There are six basic events E1-E6. The basic events cause the occurrence of their corresponding intermediate events, e.g., "Kick-Unexpected pore pressure P=1.89E−3," which means that basic event E1 has a probability of $1.89E^{-3}$ to cause kick due to unexpected pore pressure changes. The intermediate events are combined at various gates, G0-G4, and converge at the top event "Loss of Well Control (Blowout)", calculated blowout probability is $1.64E^{-5}$.

According to a further aspect of the current disclosure, Reliability Block Diagram (RBD) is employed as a reliability model to assess the MPD drilling system's reliability. A reliability block diagram is a graphical representation of the components or subsystem of the system and how they are reliability-wise related. The relationship may differ from how the components are physically connected. RBDs are constructed out of blocks. The blocks are connected with direction lines that represent the reliability relationship between the blocks. A block is usually represented in the diagram by a rectangle. In a reliability block diagram, such blocks represent the component, subsystem or assembly at its chosen black box level.

Each block in a particular RBD can also be represented by its own reliability block diagram, depending on the level of detail in question. For example, in an RBD of a MPD offshore operation, the top level blocks may represent the whole system of MPD. Each of the sub systems could have their own RBDs in which the blocks represent the subsystems of that particular system, e.g., flow control system, rotating control devices, pumps, BOP, etc. This could continue down through many levels of detail, all the way down to the level of the most basic components (e.g., valve or bolt assembly), if so desired.

The reliability-wise configuration of the components can be as simple as units arranged in a pure series or parallel configuration. There can also be systems of combined series/parallel configurations or complex systems that cannot be decomposed into groups of series and parallel configurations. The configuration types used to describe a MDP drilling system include series configuration, single parallel configuration, combined (series and parallel) configuration, complex configuration, k-out-of-n parallel configuration, configuration with a load sharing container, configuration with a standby container, configuration with inherited subdiagrams, configuration with multi blocks, and configuration with mirrored blocks.

According to one embodiment of the current disclosure, the MDP drilling system can be described in part in a series configuration. In this case, a failure of any component results in the failure of the entire system. In most cases, when considering complete systems at their basic subsystem level, it is found that these are arranged reliability-wise in a series configuration. For example, a MPD offshore application may consist of surface and subsea rotating control devices, specialized drilling fluids, and a flow control system that enables real-time detection of minute downhole influxes and losses. These are reliability-wise in series and a failure of any of these subsystems will cause a system failure. In other words, all of the units in a series system must succeed for the system to succeed.

The reliability of the system is the probability that unit 1 succeeds and unit 2 succeeds and all of the other units in the system succeed. Accordingly, all units must succeed for the system to succeed. The reliability of the system is then given by:

$$R_S = P(X_1 \cap X_2 \cap \ldots \cap X_n)$$
$$= P(X_1)P(X_2 \mid X_1)P(X_3 \mid X_1X_2) \ldots P(X_n \mid X_1X_2 \ldots X_{n-1})$$

whereby $R_s$ is the reliability of the system, $X_i$ is the event of unit i being operational, and $P(X_i)$ is probability that unit is operational In the case where the failure of a component affects the failure rates of other components (i.e., the life distribution characteristics of the other components change when one component fails), then the conditional probabilities in equation above must be considered.

However, in the case of independent components, equation above becomes:

$$R_s = P(X_1)P(X_2) \ldots P(X_n)$$

or:

$$R_s = \prod_{i=1}^{n} P(X_i)$$

Or, in terms of individual component reliability:

$$R_s = \prod_{i=1}^{n} R_i$$

In other words, for a pure series system, the system reliability is equal to the product of the reliabilities of its constituent components.

According to another embodiment of the current disclosure, the MDP drilling system can be in part described as a parallel system. For example, the MPD system has redundant pumps or motors. At least one of the units must succeed for the system to succeed. Units in parallel are also referred to as redundant units.

The probability of failure, or unreliability, for a system with n statistically independent parallel components is the probability that unit 1 fails and unit 2 fails and all of the other units in the system fail. So in a parallel system, all n units must fail for the system to fail. Put another way, if unit 1 succeeds or unit 2 succeeds or any of the n units succeeds, then the system succeeds. The unreliability of the system is then given by:

$$Q_s = P(X_1 \cap X_2 \cap \ldots \cap X_n)$$
$$= P(X_1)P(X_2 \mid X_1)P(X_3 \mid X_1X_2) \ldots P(X_n \mid X_1X_2 \ldots X_{n-1})$$

whereby $Q_s$ is the unreliability of the system, $X_i$ is the event of failure of unit i, and $P(X_i)$ is the probability of failure of unit i In the case where the failure of a component affects the failure rates of other components, then the conditional probabilities in equation above must be considered. However, in the case of independent components, the equation above becomes:

$$Q_s = P(X_1)P(X_2) \ldots P(X_n)$$

or:

$$Q_s = \prod_{i=1}^{n} P(X_i)$$

Or, in terms of component unreliability:

$$Q_s = \prod_{i=1}^{n} Q_i$$

In contrast with the series system, in which the system reliability was the product of the component reliabilities, the parallel system has the overall system unreliability as the product of the component unreliabilities.

The reliability of the parallel system is then given by:

$$R_s = 1 - Qs = 1 - (Q_1 \cdot Q_2 \cdot \ \ldots \ \cdot Q_n)$$

$$= 1 - [(1 - R_1) \cdot (1 - R_2) \cdot \ \ldots \ \cdot (1 - R_n)]$$

$$= 1 - \prod_{i=1}^{n} (1 - R_i)$$

The MPD drilling system is a time dependent system, because the subsystem, component or part wear out due to the corrosion or pressure through the operation or have the accumulated damage without being taken of very well through proper repair or maintenance activities. Accordingly, the life of the whole system or the subsystem could be described in terms of the normal distribution, exponential distribution or Weibull distribution.

For example, in a MPD drilling system with three subsystems in series, e.g., surface and subsea rotating control devices, specialized drilling fluids, and a flow control system, the system's reliability equation could be described as:

$$R_s = R_1 \cdot R_2 \cdot R_3$$

The values of $R_1$, $R_2$ and $R_3$ ere given for a common time and the reliability of the system was estimated for that time. However, since the subsystem failure characteristics can be described by distributions, the system reliability is actually time-dependent. In this case, the equation above can be rewritten as:

$$R_s(t) = R_1(t) \cdot R_2(t) \cdot R_3(t)$$

The reliability of the system for any mission time can be estimated accordingly. Assuming a Weibull life distribution for each subsystem, the first equation above can now be expressed in terms of each subsystem's reliability function, or:

$$R_s(t) = e^{-\left(\frac{t}{\eta_1}\right)^{\beta_1}} \cdot e^{-\left(\frac{t}{\eta_2}\right)^{\beta_2}} \cdot e^{-\left(\frac{t}{\eta_3}\right)^{\beta_3}}$$

In the same manner, any life distribution can be substituted into the system reliability equation. Suppose that the times-to-failure of the first subsystem are described with a Weibull distribution, the times-to-failure of the second component with an exponential distribution and the times-to-failure of the third component with a normal distribution. Then the first equation above can be written as:

$$R_s(t) = e^{-\left(\frac{t}{\eta_1}\right)^{\beta_1}} \cdot e^{-\lambda_2 t} \cdot \left[1 - \Phi\left(\frac{t - \mu_3}{\sigma_3}\right)\right]$$

Once the subsystem reliabilities are available. The reliability of the whole MPD offshore application for any mission duration can be obtained by substituting the corresponding subsystem or component reliability functions into the system reliability equation.

Figure 3:
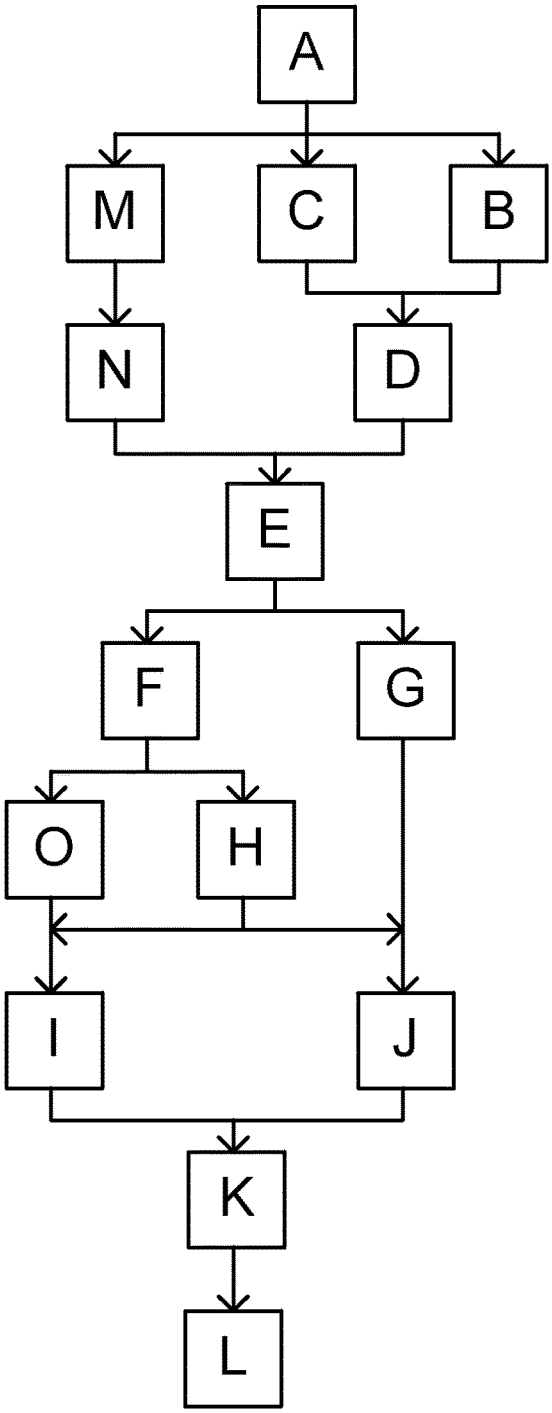
FIG. 3 is an example of a reliability block diagram of a MPD drilling system.
Figure 4:
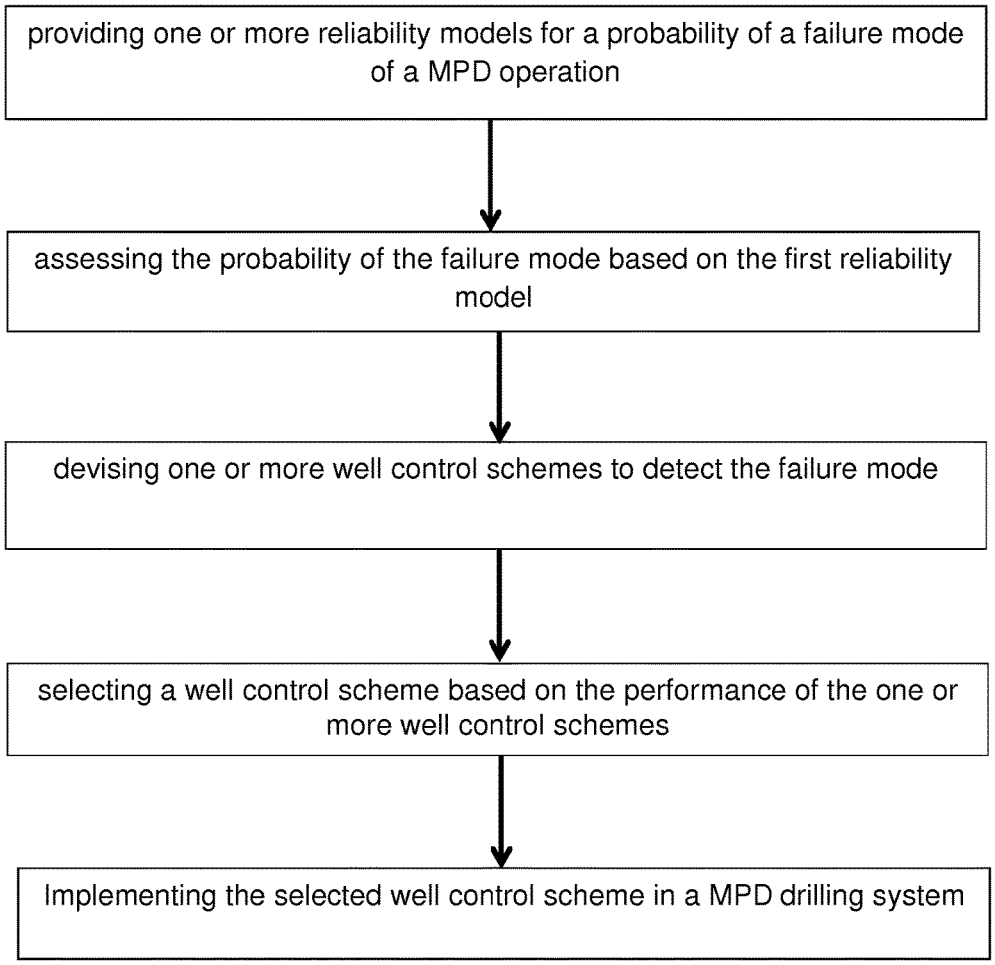
FIG. 4 illustrates a method for a managed pressure drilling (MPD) operation.

Furthermore, the whole MPD drilling system can be expressed in RBD as in FIG. 3. Blocks A to L represent the subsystem of the whole MPD offshore applications. Subsystems are in series or are in parallel to one another. The subsystems can be any subsystems organized according physical components or functions, including RCD, the choke manifold, the ambient pressure separator, pipe rams, hydraulically controlled valves, and the mud system, etc.

According to an embodiment of the current disclosure, the reliability of the whole system can be expressed by dividing the systems into different segments. Each segment has one or more blocks. The reliability of the drilling system can be expressed in reliability function of the blocks it has. For example, in the following equation, D2 represents the combination of reliability functions of blocks A to E, while D3 represents the combination of reliability functions of blocks F to K. D2 and D3 in turn can be expressed according to blocks within.

$$R_{System} = D2 \cdot D3 \cdot R_L$$

$$D3 = +R_K \cdot IK$$

$$IK = +R_I \cdot R_J \cdot R_O \cdot R_G \cdot R_F \cdot R_H - R_I \cdot R_J \cdot R_O \cdot R_G \cdot R_F - R_I \cdot R_J \cdot R_F \cdot R_H - R_I \cdot R_O \cdot R_F \cdot R_H - R_J \cdot R_G \cdot R_F \cdot R_H + R_I \cdot R_O \cdot R_F + R_I \cdot R_F \cdot R_H + R_J \cdot R_F \cdot R_H + R_J \cdot R_G$$

$$D2 = +R_A \cdot R_E \cdot IE$$

$$IE = -D1 \cdot R_M \cdot R_N + R_M \cdot R_N + D1$$

$$D1 = +R_D \cdot ID$$

$$ID = -R_B \cdot R_C + R_B + R_C$$

Substituting the terms yields:

$$R_{System} = R_A \cdot R_E \cdot R_L \cdot R_K \cdot \{(R_D \cdot R_B \cdot R_C + R_B + R_C) \cdot R_M \cdot R_N + R_M \cdot R_N - R_D \cdot R_B \cdot R_C + R_B + R_C\} \cdot \{R_I \cdot R_J \cdot R_O \cdot R_G \cdot R_F \cdot R_H - R_I \cdot R_J \cdot R_O \cdot R_G \cdot R_F - R_I \cdot R_J \cdot R_F \cdot R_H - R_I \cdot R_O \cdot R_F \cdot R_H - R_J \cdot R_G \cdot R_F \cdot R_H + R_I \cdot R_O \cdot R_F + R_I \cdot R_F \cdot R_H + R_J \cdot R_F \cdot R_H + R_J \cdot R_G\}$$

Then:

$$R_{System} = ((R_A \cdot R_E(-(R_D(-R_B \cdot R_C + R_B + R_C))R_M \cdot R_N + R_M \cdot R_N + (R_D(-R_B \cdot R_C + R_B + R_C)))) (R_K(R_I \cdot R_J \cdot R_O \cdot R_G \cdot R_F \cdot R_H - R_I \cdot R_J \cdot R_O \cdot R_G \cdot R_F - R_I \cdot R_J \cdot R_F \cdot R_H - R_I \cdot R_O \cdot R_F \cdot R_H - R_J \cdot R_G \cdot R_F \cdot R_H + R_I \cdot R_O \cdot R_F + R_I \cdot R_F \cdot R_H + R_J \cdot R_F \cdot R_H + R_J \cdot R_G))R_L)$$

In the above equation, each $R_i$ represents the reliability function of a block. For example, if $R_A$ has a Weibull distribution, then each $$R_A(t) = e^{-\left(\frac{t}{\eta_A}\right)^{\beta_A}}$$

and so forth. Substitution of each component's reliability function in the last $R_{System}$ equation above will result in an analytical expression for the system reliability, e.g., a MPD Offshore drilling system, as a function of time, or $R_s(t)$.

The reliability function of the subsystem can be constructed based on the life estimation of the subsystem. The MPD drilling system is a complex electro-mechanical system with many subsystems (or components). It is often the case that some of the components are not new. For example, a deepwater drilling platform may do many different drilling operations in its work life. Although many components can be replaced (e.g., drill strings, drill bits), others are repeatedly used in different drilling operations (e.g., pumps, BOP). It is important to know how much usable life remains in these components or subsystems.

In one embodiment of the current disclosure, the reliability function of a subsystem utilizes data on failure probability, life consumption, or remaining useful life of the subsystem. In one aspect, such data can be obtained by real-time monitoring and analysis of drilling system components using Functional Principal Component Analysis (FPCA) models. Details of the FPCA method is disclosed in copending application entitled "SYSTEM AND METHOD FOR MONITORING DRILLING SYSTEMS," filed Apr. 29, 2014, having a U.S. application Ser. No. 14/265,257, which is hereby incorporated by reference.

The method disclosed in U.S. application Ser. No. 14/265,257 is applicable to both downhole drilling tools as well as surface equipment. For example, in a MPD drilling system, the RCD has numerous seals and bearings; the back pressure pump and pressure sensor has to be accurate. The proper functioning of these components is crucial for well control.

Downhole drilling tools in a MPD drilling system include a drilling assembly, which has a drill bit and a drill collar. It may also include a downhole motor, a rotary steerable system, telemetry transmitters, as well as measurement-while-drilling (MWD) and logging-while-drilling (LWD) instruments. Downhole drilling tools also include drill pipes, casing, and packers that divide the borehole into different sections.

In one aspect of this embodiment, the life consumption of these components is estimated using FPCA models. For example, sensors are installed on the RCD to monitor the vibration or the sound of the bearings and high pressure seals. Flow meters, pressure sensors, vibration detectors, temperature sensors are installed on the circulation pumps. The sensor signals are used as inputs to the FPCA model to estimate life consumption of the bearings, the seals, or the pumps. The life consumptions of various components in turn are used to estimate the usable life of subsystems. Usable life of the subsystem is used in RBD model to estimate the reliability of the MDP drilling system.

According to still a further aspect of the current disclosure, Ishikawa diagram is used as a reliability model for risk assessment. For example, the causes for a well blowout can be categorized according to equipment, process, operator, materials, environment, and data measurement. Each category has its own causal factors. For example, equipment failures in the BOP or RCD are factors that may lead to well blowout.

According to an additional aspect of the current disclosure, Pareto chart is used as a reliability model to identify the most significant causes of a system failure. For example, the first three causes for kicks in a MPD offshore drilling are lost circulation (20%), swabbing while tripping (15%), and abnormal formation pressure (15%). Accordingly, eliminating these three causes may double the reliability of the system.

According to further aspects of the current disclosure, the reliability models can be used individually or in combination with one another to achieve a high system reliability. For example, all the reliability models can be applied to studying well blowout, identifying important causal relations, and proposing modification to the drilling system. The analysis can be either qualitative (such as in Ishikawa diagram) or quantitative (such as in FTA and RBD). Furthermore, results from the model analysis can be screened to eliminate unreliable or unreasonable results.

Embodiments of the present disclosure have been described in detail. Other embodiments will become apparent to those skilled in the art from consideration and practice of the present disclosure. Accordingly, it is intended that the specification and the drawings be considered as exemplary and explanatory only, with the true scope of the present disclosure being set forth in the following claims.

What is claimed is:

1. A method for a managed pressure drilling (MPD) operation, comprising:

operating a MPD drilling system that comprises a rotating control device (RCD), a drilling string non-return valve (NRV), and a choke manifold;

providing a first reliability model for a probability of a failure mode of the MPD operation;

assessing the probability of the failure mode based on the first reliability model;

devising a first well control scheme to detect the failure mode assessed based on the first reliability model;

providing one or more reliability models for the probability of the failure mode of the MPD operation;

assessing the probability of the failure mode based on the one or more reliability models;

devising one or more well control schemes to detect the failure mode assessed based on the corresponding one or more reliability models, comparing a result of the first well control scheme with results of the one or more well control schemes;

selecting a well control scheme among the first well control scheme and the one or more well control schemes; and modifying the MPD drilling system according to the selected well control scheme, wherein the first reliability model and one or more reliability models are different, and are selected from the group consisting of a Failure Modes and Effects Analysis (FMEA), a Fault Tree Analysis (FTA), an Ishikawa diagram, a Pareto Chart, a Reliability Block Diagram (RBD), and combinations thereof.

2. The method of claim 1, wherein the failure mode is selected from a group consisting of from inability to making drilling mud, lost circulation, gain in mud pit level, incorrect mud weight measurements level, change of mud properties, absence of kill weight mud, inability to stab-in Inside Blowout Preventer (IBOP) or Full-Opening Safety Valve (FOSV), line rupture, loss of pressure control, unexpected gas to surface, gas in riser, obstruction in pump line, failure of pump, wellbore instability, continuous wellbore influx, high Bottom Hole Pressure (BHP), formation fracture, kick, BHP surge, unsuccessful well control, lost circulation, inability to remedy mud loss, and high Equivalent Circulating Density (ECD).

3. The method of claim 1, wherein the MPD drilling system is divided into a plurality of subsystems, and wherein a reliability function of the MPD drilling system is expressed based on reliability functions of the plurality of subsystems.

4. The method of claim 3, wherein a life of one of the plurality of subsystems is obtained using a Functional Principal Component Analysis (FPCA).

5. The method of claim 1, wherein a life of the MPD drilling system or one of the plurality of subsystems thereof is expressed according to a normal distribution, an exponential distribution, or a Weibull distribution.

6. The method of claim 1, wherein the reliability model is the FMEA, wherein a risk priority number (RPN) is calculated for the failure mode.

7. The method of claim 1, wherein the reliability model is the Ishikawa diagram, wherein the Ishikawa diagram is used to identify the failure mode that most frequently causes loss of well control.

8. The method of claim 1, wherein the reliability model is the Pareto chart, wherein the Pareto chart is used to identify failure modes that cause loss of well control.

9. The method of claim 1, further comprising modifying the MPD drilling system based on the selected well control scheme.

10. The method of claim 1, wherein the MPD system is used in offshore drilling operations.

11. A managed pressure drilling system, comprising:

a rotating control device (RCD), a drilling string non-return valve (NRV), a choke manifold, and a plurality of downhole drilling tools, wherein a reliability of the system is assessed using one or more reliability models selected from a group consisting of Failure Modes and Effects Analysis (FMEA), Fault Tree Analysis (FTA), Ishikawa diagram, Pareto chart, Reliability Block Diagram (RBD), and combinations thereof, wherein one or more parts of the drilling system and a remaining live of the one of more parts is estimated using Functional Principal Component Analysis (FPCA), wherein the remaining live is employed in the Reliability Block Diagram (RBD).

12. The system of claim 11, wherein a failure in the system is selected from a group consisting of inability to making drilling mud, lost circulation, gain in mud pit level, incorrect mud weight measurements level, change of mud properties, absence of kill weight mud, inability to stab-in Inside Blowout Preventer (IBOP) or Full-Opening Safety Valve (FOSV), line rupture, loss of pressure control, unexpected gas to surface, gas in riser, obstruction in pump line, failure of pump, wellbore instability, continuous wellbore influx, high Bottom Hole Pressure (BHP), formation fracture, kick, BHP surge, unsuccessful well control, lost circulation, inability to remedy mud loss, and high Equivalent Circulating Density (ECD).

13. The system of claim 11, wherein the system is used in offshore drilling operations.

* * * * *